US006540507B1

(12) United States Patent
Yang

(10) Patent No.: US 6,540,507 B1
(45) Date of Patent: Apr. 1, 2003

(54) PIEZOELECTRIC LIGHTER WITH SAFETY LOCK

(76) Inventor: John Jiin Chung Yang, 15443 Proctor Ave., Suite B, Industry, CA (US) 91745

( * ) Notice: Subject to any disclaimer, the term of this patent is extended or adjusted under 35 U.S.C. 154(b) by 0 days.

(21) Appl. No.: 10/155,941

(22) Filed: May 28, 2002

(51) Int. Cl.[7] ..... F23D 11/36
(52) U.S. Cl. ..... 431/153; 431/255
(58) Field of Search ..... 431/255, 153

(56) References Cited

U.S. PATENT DOCUMENTS 4,784,602 A * 11/1988 Nitta ..... 431/153
5,145,358 A * 9/1992 Shike et al. ..... 431/153
5,531,591 A * 7/1996 Yamazaki ..... 431/153
5,833,448 A * 11/1998 Doucet et al. ..... 431/153
6,086,358 A * 7/2000 Potskhishvili et al. ..... 431/153
6,135,761 A * 10/2000 Chen ..... 431/132
6,287,109 B1 * 9/2001 Hirota ..... 431/153

* cited by examiner

*Primary Examiner*—Henry Bennett
*Assistant Examiner*—Alfred Basichas
(74) *Attorney, Agent, or Firm*—Raymond Y. Chan; David and Raymond Patent Group

(57) ABSTRACT

A piezoelectric lighter incorporates with a safety lock which includes an ignition cap slidably mounted on the casing in a radially movable manner, a blocking stopper supported in the ignition cavity, a locking member including a locking latch disposed the ignition cavity and extended to a position that the locking latch is blocked by the blocking stopper, so as to lock up the ignition cap from ignition. To unlocked the safety lock, the locking latch is moved away from the blocking stopper so as to release the blocking up of the ignition cap with respect to the blocking stopper, so that the ignition cap is capable of being slid sidewardly and downwardly to ignite the piezoelectric lighter.

20 Claims, 4 Drawing Sheets

PIEZOELECTRIC LIGHTER WITH SAFETY LOCK

BACKGROUND OF THE PRESENT INVENTION

1. Field of Invention

The present invention relates to a piezoelectric lighter, and more particularly to a piezoelectric lighter with a safety lock which normally locks up the ignition cap of the piezoelectric lighter so as to prevent the piezoelectric lighter from being ignited accidentally or by children.

2. Description of Related Arts

Piezoelectric lighters have been known and sold throughout the United States. Generally, there are two types of piezoelectric lighter, namely the push-down type piezoelectric lighter that the ignition button must be depressed downwardly for ignition and the slide-down type piezoelectric lighter that the ignition button must be pushed to slide downwardly and rearwardly at the same time for ignition.

Due to safety purpose, both government and the consumers in United States demand a safety device employed in every lighter to prevent any unwanted ignition of the lighter. In order to prevent the ignition of the push-down type piezoelectric lighter, the safety device can simply block the downward movement of the ignition button so as to lock up the ignition button from ignition. However, the convention safety device which is designed for locking up the downwardly ignition button cannot fit the structure of the slide-down type piezoelectric lighter.

According to the slide-down type piezoelectric lighter, the ignition button is slidably mounted on the casing of the lighter in a radially movable manner about an operation axle provided in the casing, wherein the ignition button has a depressing arm extended to rest on the piezoelectric unit and arranged in such a manner that when the ignition button is depressed sidewardly and downwardly at the same time, the depressing arm will be driven to downwardly compress the piezoelectric unit to ignite the piezoelectric lighter. In other words, the ignition button must be traveled a radial pathway with respect to its operation axle for ignition.

An improved slide-down type piezoelectric lighter comprises a locking switch slidably mounted on the ignition button and a locking member extended from the locking switch to a rear edge of the casing to block the radial movement of the ignition button in order to lock up the ignition of the lighter. However, such locking switch is disadvantage in practice use, especially when the locking switch must be pushed forward to drive the locking member away from the radial pathway of the ignition button. The conflict movements of the locking switch and the ignition button will cause the difficulty of the ignition operation.

Moreover, the structure of the locking switch is more complicated that the original structural design of the piezoelectric lighter must be altered so as to highly increase the manufacturing cost of the piezoelectric lighter. Thus, not all the countries require the piezoelectric to employ with the safety device such that it is not economy for the manufacturer to make the piezoelectric lighters to fit both the markets whether the markets require the safety device or not.

SUMMARY OF THE PRESENT INVENTION

A main object of the present invention is to provide a piezoelectric lighter with a safety lock which normally locks up the radially ignition motion of the ignition cap so as to prevent any unwanted ignition of the piezoelectric lighter.

Another object of the present invention is to provide a piezoelectric lighter with a safety lock, wherein the ignition of the piezoelectric lighter requires a single continuous action operation by an adult, i.e. firstly push the safety lock rearwardly and secondly push the ignition button rearwardly and downwardly. However, a child is unable to complete the two movements in one single action so that the safety lock can prevent the piezoelectric lighter from being ignited by the children.

Another object of the present invention is to provide a piezoelectric lighter with a safety lock which does not require to alter the original structural design of the piezoelectric lighter, so as to minimize the manufacturing cost of incorporating the safety lock with every conventional slide-down type piezoelectric lighter having the ignition cap.

Another object of the present invention is to provide a piezoelectric lighter with a safety lock, wherein the safety lock is adapted to mount on all kinds of the ignition button of the slide-down type piezoelectric lighter to provide the locking feature of the ignition button. In other words, the manufacturer is able to simply make a universal lighter body to incorporate with the ignition button having the safety lock to fit the markets that requires the safety feature or the ignition button without the safety lock to fit the markets that do not require the safety feature.

Accordingly, in order to accomplish the above objects, the present invention provides a piezoelectric lighter, comprising:

a casing receiving a liquefied gas storage, an ignition cavity and a nozzle cavity provided in front of the ignition cavity;

a gas emitting nozzle disposed in the nozzle cavity of the casing and communicating with the liquefied gas storage for control a flow of gas;

a piezoelectric unit disposed in the ignition cavity of the casing for generating piezoelectricity; and a safety lock, comprising:

an ignition cap, having a guiding slot, slidably mounted on the casing in a radially movable manner about an operation axle provided in the casing to define a radial traveling region within the ignition cavity, wherein the ignition cap comprises a depressing arm extended to rest on the piezoelectric unit and arranged in such a manner that when the ignition cap is depressed sidewardly and downwardly at the same time, the depressing arm is driven to downwardly compress the piezoelectric unit to ignite the piezoelectric lighter;

a blocking stopper provided at a front portion of the ignition cavity within the radial traveling region;

a locking member comprising a locking latch disposed in the ignition cavity and an operation button extended from the locking latch to outside through the guiding slot, wherein the locking latch is movably fitted in the ignition cavity in such a manner that the locking latch is arranged to be driven by the operation button to move from a normally locked position to an unlocked position; and means for retaining the locking member at the locking position, wherein at the locking position, the locking latch is extended within the radial traveling region at a position that the locking latch is blocked by the blocking stopper, so as to lock up the ignition cap from ignition, and at the unlocked position, the locking latch is moved away from the radial traveling region so as to release the blocking up of the ignition cap with respect to the blocking stopper, so that the ignition cap is capable of being slid sidewardly and downwardly to ignite the piezoelectric lighter.

DETAILED DESCRIPTION OF THE PREFERRED EMBODIMENT

Figure 1:
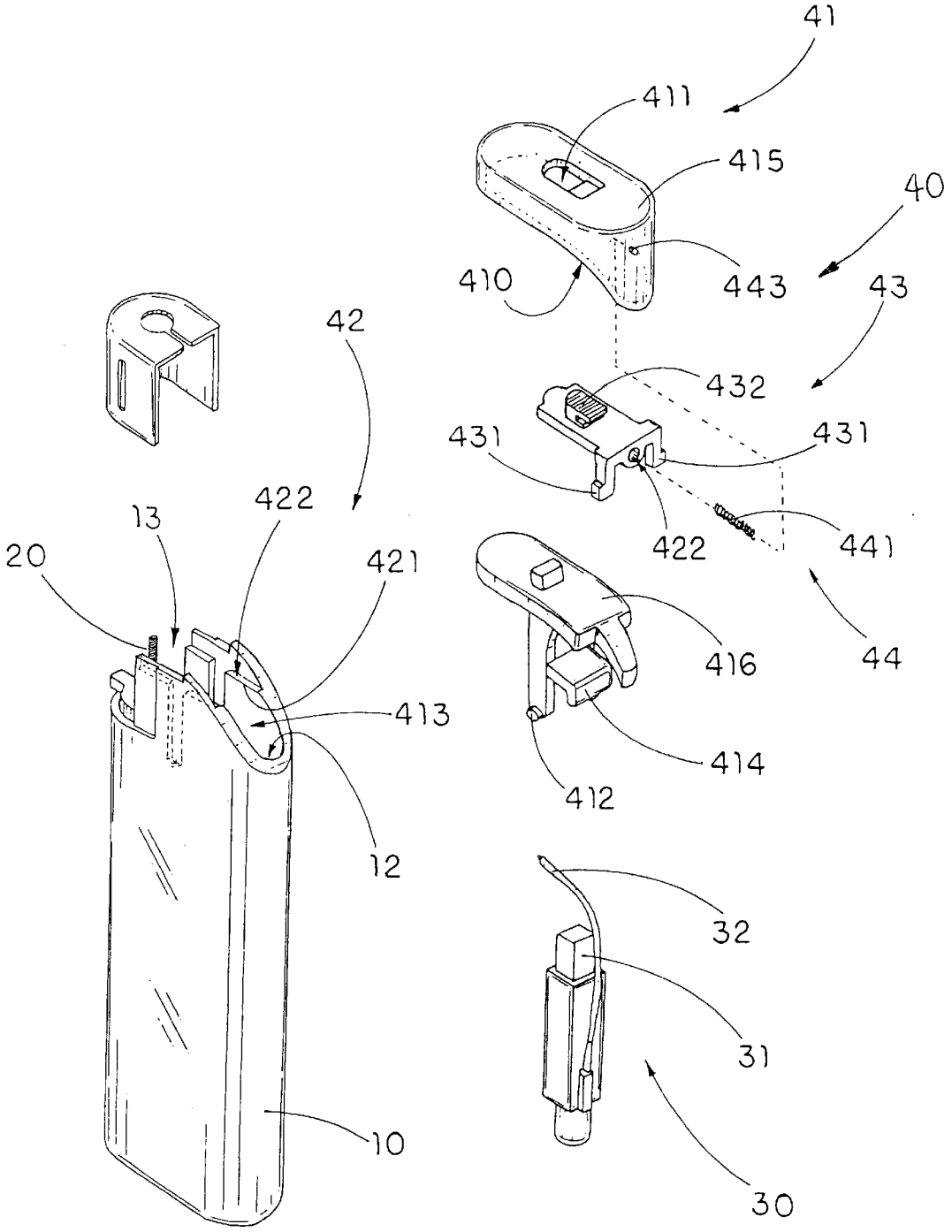
FIG. 1 is an exploded perspective view of a piezoelectric lighter with a safety lock according to a preferred embodiment of the present invention.
Figure 2:
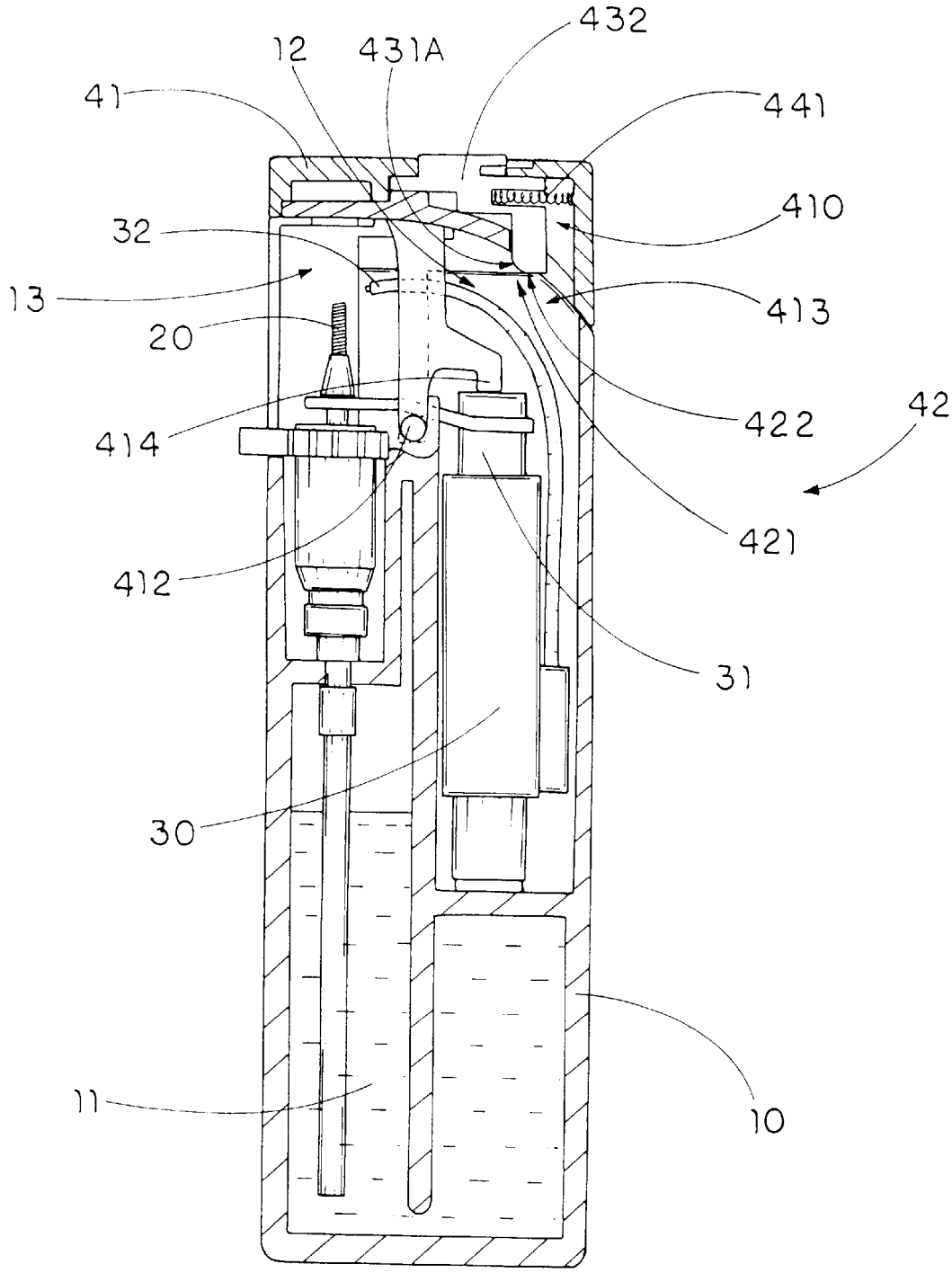
FIG. 2 is a sectional view of the piezoelectric lighter in a locked position according to the above preferred embodiment of the present invention.

Referring to FIGS. 1 and 2 of the drawings, a piezoelectric lighter according to a preferred embodiment of the present invention is illustrated, wherein the piezoelectric lighter, such as a standard piezoelectric lighter, comprises a casing 10 receiving a liquefied gas storage 11, an ignition cavity 12, and a nozzle cavity 13 provided in front of the ignition cavity 12, and a gas emitting nozzle 20 disposed in the nozzle cavity 13 of the casing 10 and communicating with the liquefied gas storage 11 for control a flow of gas.

The piezoelectric lighter further comprises a piezoelectric unit 30, which is disposed in the ignition cavity 12 of the casing 10 for generating piezoelectricity, comprising a movable operating part 31 extended upwardly and an ignition tip 32 extended to a position closed to the gas emitting nozzle 20, wherein when the movable operating part 31 is depressed downwardly, sparks are generated from the ignition tip 32 to ignite the gas emitted from the gas emitting nozzle 20 at the same time.

As shown in FIG. 1, the piezoelectric lighter further comprises a safety lock 40 which comprises an ignition cap 41, a blocking stopper 42, and a locking member 43.

The ignition cap 41, having a guiding slot 411, is slidably mounted on the casing 10 in a radially movable manner about an operation axle 412 provided in the casing 10 to define a radial traveling region 413 within the ignition cavity 12, wherein the ignition cap 41 comprises a depressing arm 414 extended to rest on the movable operating part 31 of the piezoelectric unit 30 and arranged in such a manner that when the ignition cap 41 is depressed sidewardly and downwardly at the same time, the depressing arm 414 is driven to downwardly compress the piezoelectric unit 30 to ignite the piezoelectric lighter.

The blocking stopper 42 is provided at a front portion of the ignition cavity 12 within the radial traveling region 413. The locking member 43 comprises a locking latch 431 disposed in the ignition cavity 12 and an operation button 432 extended from the locking latch 431 to outside through the guiding slot 411, wherein the locking latch 431 is movably fitted in the ignition cavity 12 in such a manner that the locking latch 431 is arranged to be driven by the operation button 432 to move from a normally locked position to an unlocked position.

The safety lock 40 further comprises means 44 for retaining the locking member 43 at the locking position, wherein at the locking position, the locking latch 431 is extended within the radial traveling region 413 at a position that the locking latch 431 is blocked by the blocking stopper 42, so as to lock up a radial movement of the ignition cap 41 from ignition, and at the unlocked position, the locking latch 431 is moved away from the radial traveling region 413 so as to release the blocking up of the ignition cap 41 with respect to the blocking stopper 42, so that the ignition cap 41 is capable of being slid sidewardly and downwardly to ignite the piezoelectric lighter.

According to the preferred embodiment, the blocking stopper 42 is constructed as two blocking edges 421 integrally protruded from two inner walls of the ignition cavity 12 of the casing 10 within the radial traveling region 413 wherein each of the blocking edges 421 has a top blocking surface 422 that faces upwardly towards the locking latch 431 of the locking member 43. Accordingly, a thickness of each top portion of the inner walls is reduced to form the blocking edge 421 in such a manner that the respective top blocking surface 422 of the blocking stopper 42 is transversely extended on the front portion of the respective inner wall of the ignition cavity 12, as shown in FIG. 1. Moreover, the top blocking surface 422 of each blocking edge 421 should have a predetermined width adapted to block the radial movement of ignition cap 41 by the locking latch 431.

The operation button 432 is slidably mounted on the ignition cap 41 wherein the locking latch 431 is downwardly extended from the operation button 432 into the ignition cavity 12 through the guiding slot 411. Accordingly, the guiding slot 411 is an elongated slot formed on top of the ignition cap 41 wherein the guiding slot 411 has a predetermined length that allows the operation button 432 to be pushed rearwardly enough to move the locking latch 431 out of the radial traveling region 413 in the ignition cavity 12 in purpose of unlocking the safety lock 40 of the piezoelectric lighter.

As shown in FIG. 2, the locking latch 431 is slidably fitted in the ignition cavity 12 wherein a bottom end of the locking latch 431 is positioned on top of the top blocking surface 422 of the blocking stopper 42. At the normal locked position, as shown in FIG. 2, the bottom end of the locking latch 431 is extended into the ignition cavity 12 in order to block the ignition cap 41 from being radially moved sidewardly by the top blocking surface 422 of the blocking stopper 42. Accordingly, there are two locking latches 431 downwardly extended from the operation button 432 to the top of the top blocking surfaces 422 of the blocking edges 421, as shown in FIG. 1.

Figure 3:
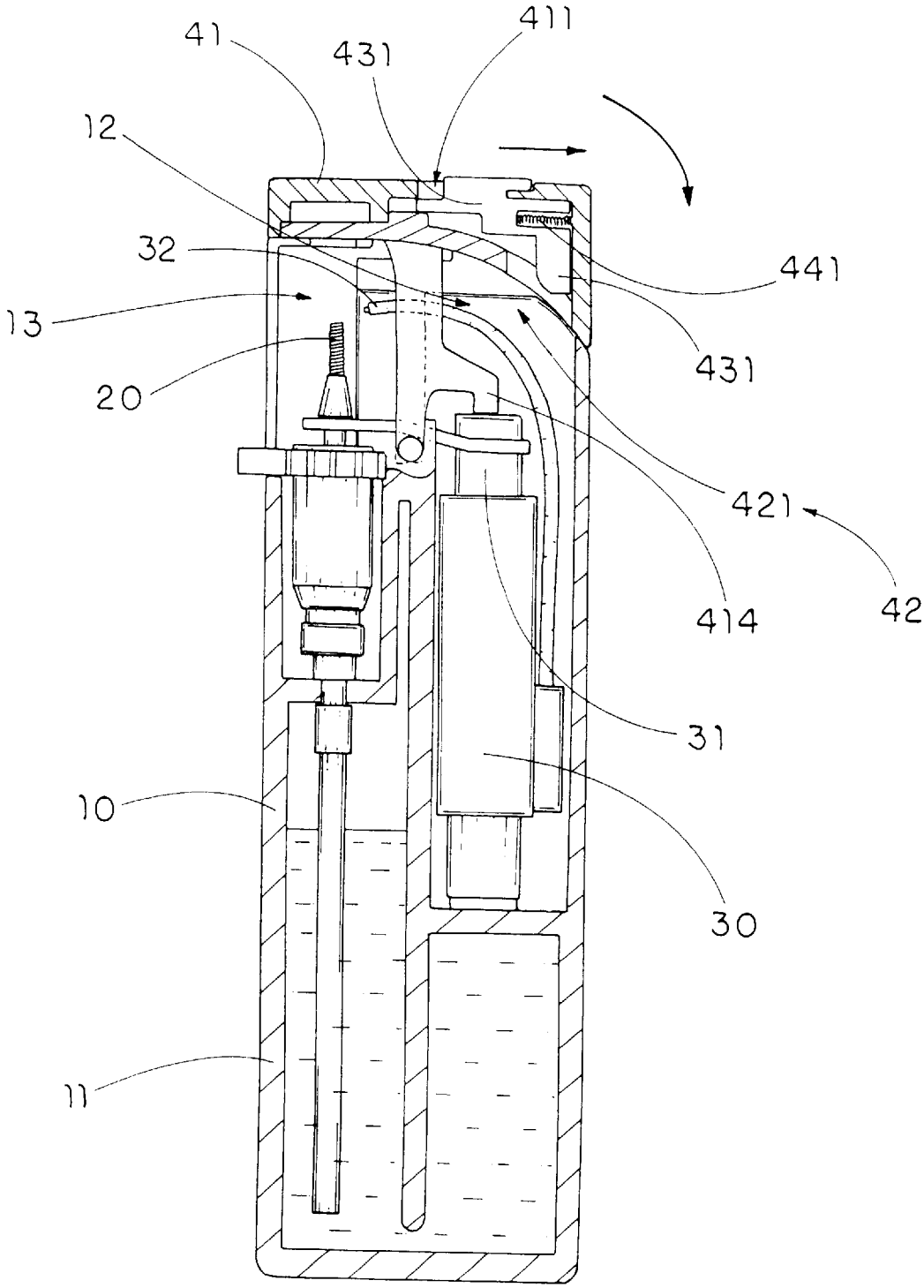
FIG. 3 is a sectional view of the piezoelectric lighter in an unlocked position according to the above preferred embodiment of the present invention.

When the locking latch 431 is moved rearwardly by the operation button 432, the bottom end of the locking latch 431 is moved behind a rear end of the respective blocking edge 421, which is moved out of the radial traveling region 413 of the ignition cavity 12, as shown in FIG. 3, so as to release the blocking up of the ignition cap 41 with respect to the top blocking surface 422 of the blocking stopper 42, so that the ignition cap 41 is capable of being slid radially to ignite the piezoelectric lighter. In other words, each of the blocking edges 421 has a predetermined length that each locking latch 431 is adapted to be moved from the locking position, i.e. on top of the blocking edge 421, to the unlocked position, i.e. behind the rear end of the blocking edge 421.

The retaining means 44 comprises a resilient element 441 disposed in the ignition cap 41 for applying an urging pressure against the locking member 43 so as to normally retain the locking member 43 at the locking position. As shown in FIG. 2, the resilient element 441, according to the preferred embodiment, is a compression spring provided between the operation button 432 and an inner side of a rear wall of the ignition cap 41 wherein the resilient element 441 has two ends biasing against the operation button 432 and the rear wall of the ignition cap 41. The resilient element 441 will normally urge and retain the locking member 43 frontwardly that the bottom end of the locking latch 431 positioned on top of the blocking stopper 42 to block up the ignition cap 41 from being slid radially from the casing 10, so as to lock up the ignition cap 41 from ignition.

Accordingly, a height of the rear wall of the ignition cap 41 must be at least larger than a height of the locking latch 431 in such a manner that when the locking latch 431 is rearwardly moved out of the radial traveling region 413 of the ignition cavity 12, the locking latch 431 is entirely received in the ignition cap 41 so as to release the blocking up of the ignition cap 41 with respect to the blocking stopper 42, as shown in FIG. 3.

As shown in FIG. 3, the bottom end of the locking latch 431 has a front sloping surface 431A for ensuring the locking latch 431 to slide back to an original locked position along the blocking stopper 42. When the ignition cap 41 is slid radially for ignition, the bottom end of the locking latch 431 is pulled rearwardly. Therefore, when the ignition cap 41 is rebounded to the original locked position thereof after ignition, the front sloping surface 431 A of the bottom end of the locking latch 431, which urges against the rear end of the blocking edge 421 of the blocking stopper 42, compresses the retaining means 44 and guides the locking latch 431 sliding back on top of the top blocking surface 422 of the blocking stopper 42.

Figure 4:
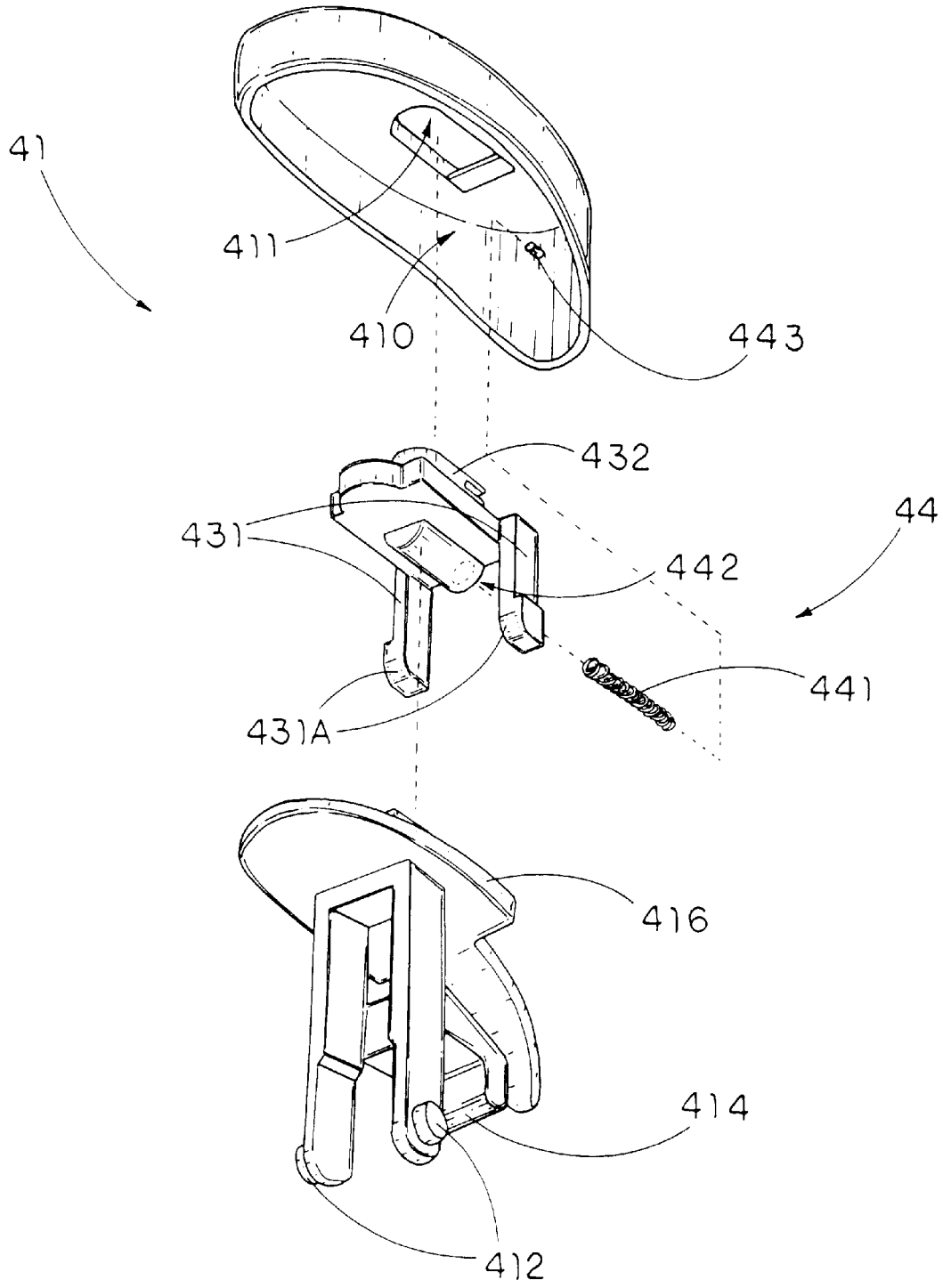
FIG. 4 is an exploded perspective view of an ignition cap of the piezoelectric lighter according to the above preferred embodiment of the present invention.

As shown in FIG. 4, the retaining means 44 further comprises a first holder 442 provided on a rear side of the operation button 432 and a second holder 443 provided on the inner side of the rear wall of the ignition cap 41 wherein the first and second holders 442, 443 are arranged to securely hold two ends of the resilient element 441 respectively, so as to retain the resilient element 441 between the operation button 432 and the rear wall of the ignition cap 41. Accordingly, the first holder 442 is a socket provided at the rear side of the operation button 432 to receive one end of the resilient element 441 and the second holder 443 is a protrusion, having rod-like shaped, protruded from the inner side of the rear wall of the ignition cap 41 to insert into another end of the resilient element 441.

As shown in FIG. 4, the ignition cap 41 comprises a cap cover 415 and a cap base 416 mounted underneath the cap cover 415 to define a receiving cavity 410 between the cap cover 415 and the cap base 416 wherein the operation button 432 is slidably received in the receiving cavity 410 such that a top portion of the operation button 432 is extended to outside through the guiding slot 411 provided on the cap cover 415 while the locking latch 431 is downwardly extended into the ignition cavity 12.

Accordingly, the resilient element 441 of the retaining means 44 is disposed in the receiving cavity 410 for applying the urging pressure against the operation button 432 and the rear wall of the cap cover 415 of the ignition cap 41 so as to normally push the locking latch 431 frontwardly at the locked position.

The cap base 416 is securely mounted to a bottom side of the cap cover 415 wherein the depressing arm 414 is downwardly extended from the cap base 416 to rest on top of the movable operating part 31 of the piezoelectric unit 30.

In order to ignite the piezoelectric lighter, an adult must apply a rearward pushing force on the operation button 432 to push the bottom end of the locking latch 431 out of the radial traveling region 413, so as to release the blocking up of the ignition cap 41 with respect to the blocking stopper 42. While maintaining the locking latch 431 in the unlocked position, simultaneously, the adult may apply a radial force on the ignition cap 41 to depress the movable operating part 31 of the piezoelectric unit 30 to ignite the piezoelectric lighter.

In accordance with the preferred embodiment as disclosed above, the safety lock can prevent the piezoelectric lighter of the present invention to be unintentional ignited. Moreover, the original structural design of the piezoelectric lighter does not require alteration in order to be incorporated with the safety lock. Therefore, the lighter manufacturer is able to make a conventional ignition cap or the ignition cap of the safety lock to incorporate with the casing for safety purpose, so as to fit all the markets whether the piezoelectric lighter requires the safety feature or not.

What is claimed is:

1. A piezoelectric lighter, comprising:

a casing receiving a liquefied gas storage, an ignition cavity, and a nozzle cavity provided in front of said ignition cavity;

a gas emitting nozzle disposed in said nozzle cavity of said casing and communicating with said liquefied gas storage for controlling a flow of gas;

a piezoelectric unit disposed in said ignition cavity of said casing for generating piezoelectricity; and a safety lock, comprising:

an ignition cap, having a guiding slot, slidably mounted on said casing in a radially movable manner about an operation axle provided in said casing to define a radial traveling region within said ignition cavity, wherein said ignition cap comprises a depressing arm extended to rest on said piezoelectric unit and arranged in such a manner that when said ignition cap is depressed sidewardly and downwardly at said same time, said depressing arm is driven to downwardly compress said piezoelectric unit to ignite said piezoelectric lighter;

a blocking stopper provided at a front portion of said ignition cavity within said radial traveling region;

a locking member comprising a locking latch disposed in said ignition cavity and an operation button extended from said locking latch to outside through said guiding slot, wherein said locking latch is movably fitted in said ignition cavity in such a manner that said locking latch is arranged to be driven by said operation button to move from a normally locked position to an unlocked position; and means for retaining said locking member at said locking position, wherein at said locking position, said locking latch is extended within said radial traveling region at a position that said locking latch is blocked by said blocking stopper, so as to lock up said ignition cap from ignition, and at said unlocked position, said locking latch is moved away from said radial traveling region so as to release a blocking up of said ignition cap with respect to said blocking stopper, so that said ignition cap is capable of being slid sidewardly and downwardly to ignite said piezoelectric lighter.

2. A piezoelectric lighter, as recited in claim 1, wherein said blocking stopper, having a top blocking surface, provided on an inner wall of said ignition cavity of said casing within said radial traveling region, wherein a bottom end of said locking latch is extended into said radial traveling region at a position on top of said top blocking surface of said blocking stopper so as to block said ignition cap from being radially moved for ignition.

3. A piezoelectric lighter, as recited in claim 2, wherein said bottom end of said locking latch has a front sloping surface for ensuring said locking latch to slide back to said locked position along said blocking stopper.

4. A piezoelectric lighter, as recited in claim 2, wherein said blocking stopper is constructed as two blocking edges integrally protruded from said front portions of said two inner walls of said ignition cavity of said casing to form said top blocking surfaces respectively in such a manner that said locking latch is arranged to be moved rearwardly until said bottom end of said locking latch is moved behind a rear end of said respective blocking edge so as to release said blocking up of said ignition cap with respect to said blocking stopper.

5. A piezoelectric lighter, as recited in claim 3, wherein said blocking stopper is constructed as two blocking edges integrally protruded from said front portions of said two inner walls of said ignition cavity of said casing to form said top blocking surfaces respectively in such a manner that said locking latch is arranged to be moved rearwardly until said bottom end of said locking latch is moved behind a rear end of said respective blocking edge so as to release said blocking up of said ignition cap with respect to said blocking stopper.

6. A piezoelectric lighter, as recited in claim 4, wherein each of said blocking edges is formed by reducing a thickness of a top portion of said respective inner wall in such a manner that said respective top blocking surface of said blocking stopper is transversely extended on said front portion of said respective inner wall of said ignition cavity.

7. A piezoelectric lighter, as recited in claim 5, wherein each of said blocking edges is formed by reducing a thickness of a top portion of said respective inner wall in such a manner that said respective top blocking surface of said blocking stopper is transversely extended on said front portion of said respective inner wall of said ignition cavity.

8. A piezoelectric lighter, as recited in claim 1, wherein said guiding slot is an elongated slot formed on top of said ignition cap, wherein said guiding slot has a predetermined length that allows said operation button to be pushed rearwardly enough to move said locking latch out of said radial traveling region of said ignition cavity in purpose of unlocking said safety lock of said piezoelectric lighter.

9. A piezoelectric lighter, as recited in claim 2, wherein said guiding slot is an elongated slot formed on top of said ignition cap, wherein said guiding slot has a predetermined length that allows said operation button to be pushed rearwardly enough to move said locking latch out of said radial traveling region of said ignition cavity in purpose of unlocking said safety lock of said piezoelectric lighter.

10. A piezoelectric lighter, as recited in claim 5, wherein said guiding slot is an elongated slot formed on top of said ignition cap, wherein said guiding slot has a predetermined length that allows said operation button to be pushed rearwardly enough to move said locking latch out of said radial traveling region of said ignition cavity in purpose of unlocking said safety lock of said piezoelectric lighter.

11. A piezoelectric lighter, as recited in claim 7, wherein said guiding slot is an elongated slot formed on top of said ignition cap, wherein said guiding slot has a predetermined length that allows said operation button to be pushed rearwardly enough to move said locking latch out of said radial traveling region of said ignition cavity in purpose of unlocking said safety lock of said piezoelectric lighter.

12. A piezoelectric lighter, as recited in claim 2, wherein a rear wall of said ignition cap has a height at least larger than a height of said locking latch in such a manner that when said locking latch is rearwardly moved out of said radial traveling region, said locking latch is entirely received in said ignition cap so as to release said blocking up of said ignition cap with respect to said blocking stopper.

13. A piezoelectric lighter, as recited in claim 5, wherein a rear wall of said ignition cap has a height at least larger than a height of said locking latch in such a manner that when said locking latch is rearwardly moved out of said radial traveling region, said locking latch is entirely received in said ignition cap so as to release said blocking up of said ignition cap with respect to said blocking stopper.

14. A piezoelectric lighter, as recited in claim 7, wherein a rear wall of said ignition cap has a height at least larger than a height of said locking latch in such a manner that when said locking latch is rearwardly moved out of said radial traveling region, said locking latch is entirely received in said ignition cap so as to release said blocking up of said ignition cap with respect to said blocking stopper.

15. A piezoelectric lighter, as recited in claim 1, wherein said ignition cap comprises a cap cover and a cap base mounted underneath said cap cover to define a receiving cavity between said cap cover and said cap base, wherein said operation button is slidably received in said receiving cavity such that a top portion of said operation button is extended to outside through said guiding slot provided on said cap cover while said locking latch is downwardly extended into said ignition cavity.

16. A piezoelectric lighter, as recited in claim 5, wherein said ignition cap comprises a cap cover and a cap base mounted underneath said cap cover to define a receiving cavity between said cap cover and said cap base, wherein said operation button is slidably received in said receiving cavity such that a top portion of said operation button is extended to outside through said guiding slot provided on said cap cover while said locking latch is downwardly extended into said ignition cavity.

17. A piezoelectric lighter, as recited in claim 7, wherein said ignition cap comprises a cap cover and a cap base mounted underneath said cap cover to define a receiving cavity between said cap cover and said cap base, wherein said operation button is slidably received in said receiving cavity such that a top portion of said operation button is extended to outside through said guiding slot provided on said cap cover while said locking latch is downwardly extended into said ignition cavity.

18. A piezoelectric lighter, as recited in claim 15, wherein said retaining means comprises a resilient element disposed in said receiving cavity for applying an urging pressure against said operation button, wherein said resilient element has two ends biasing against said operation button and said ignition cap, so as to normally retain said locking latch in said locked position.

19. A piezoelectric lighter, as recited in claim 16, wherein said retaining means comprises a resilient element disposed in said receiving cavity for applying an urging pressure against said operation button, wherein said resilient element has two ends biasing against said operation button and said ignition cap, so as to normally retain said locking latch in said locked position.

20. A piezoelectric lighter, as recited in claim 17, wherein said retaining means comprises a resilient element disposed in said receiving cavity for applying an urging pressure against said operation button, wherein said resilient element has two ends biasing against said operation button and said ignition cap, so as to normally retain said locking latch in said locked position.

* * * * *